United States Patent [19]

Verschuur

[11] 4,138,226

[45] Feb. 6, 1979

[54] PROCESS FOR PREPARING A SUSPENSION OF PARTICLES IN A HYDROCARBON OIL

[75] Inventor: Eke Verschuur, Amsterdam, Netherlands

[73] Assignee: Shell Oil Company, Houston, Tex.

[21] Appl. No.: 782,879

[22] Filed: Mar. 30, 1977

[30] Foreign Application Priority Data

Mar. 31, 1976 [GB] United Kingdom ..... 13024/76

[51] Int. Cl.[2] ..... C10L 1/32

[52] U.S. Cl. ..... 44/51; 44/24

[58] Field of Search ..... 44/24, 51

[56] References Cited

U.S. PATENT DOCUMENTS

| | | | |
|---|---|---|---|
| 1,929,860 | 10/1933 | Trent | 44/24 |
| 2,430,085 | 11/1947 | Spencer et al. | 44/51 |

*Primary Examiner*—Winston A. Douglas
*Assistant Examiner*—Y. Harris-Smith

[57] ABSTRACT

Coal particles suspended in water are agglomerated with a binder and the agglomerates are separated from the water and disintegrated in a liquid. Coarse coal particles are removed, ground, and returned for agglomeration.

15 Claims, No Drawings

PROCESS FOR PREPARING A SUSPENSION OF PARTICLES IN A HYDROCARBON OIL

BACKGROUND OF THE INVENTION

The invention relates to a process for preparing a suspension of coal particles in a hydrocarbon fuel. Such suspensions make excellent fuels and, if the suspended coal particles are small enough, can be atomized as a liquid fuel in a burner. For the preparation of the suspensions the amount and particle size distribution of the solid must be chosen such that a dynamically and, if desired, statically stable suspension is obtained wherein the particles do not segregate or agglomerate. The ultimately allowable viscosity, too, puts limits to the amount and shape of the solid material in these suspensions. Within the scope of these limits it is, however, very well possible to prepare attractive fuels.

As will be apparent to those skilled in the art, the solid material has to be distributed as homogeneously as possible through the hydrocarbon fuel. With the preparation of the suspensions the latter requirement gives rise to problems. It is difficult to mix an amount of dry coal powder homogeneously with the required amount of hydrocarbon fuel. This calls for a relatively large amount of energy and expensive equipment, one problem being the abrasive character of dry coal powder.

For application of the suspensions as fuel, it is desirable that the coal particles contain as little ash as possible. Since most coals contain a relatively high percentage of ash, the coal often has to be de-ashed before it can be made into the suspension. This de-ashing, too, requires relatively much energy and expensive equipment. A need, therefore, has existed for a method of preparing such suspensions which is inexpensive and which does not require a large energy input.

In one proposed process described in U.S. Ser. No. 720,703, filed Sept. 7, 1976, now abandoned, and whose disclosure is incorporated herein by reference, a suspension of coal particles in a hydrocarbon fuel is prepared by contacting an aqueous suspension of ash-containing coal particles under turbulent conditions in an agglomeration zone with a binder preferably hydrocarbon-based, to form agglomerates of coal particles and binder, while excluding at least part of the ash, and separating the agglomerates from an ash-containing water phase by taking the agglomerates up in a hydrocarbon fuel and disintegrating the agglomerates, while in said hydrocarbon fuel, to suspend the resulting coal particles in the hydrocarbon fuel.

In this manner, the coal is de-ashed and brought in a form wherein it is relatively easy to take the coal up in an excess hydrocarbon fuel. Due to the presence of the binder in the agglomerates and to the fact that the agglomerates are much larger than the individual coal particles, the mixing of the coal (i.e., the agglomerates) with the hydrocarbon fuel proceeds much more easily than if dry coal powder were mixed with the fuel. Possibly this is partly due to the fact that the coal particles have already been wetted with hydrocarbon before the mixing with fuel takes place, i.e., during agglomeration.

The proposed process starts from an aqueous suspension of coal particles. This suspension, whereof the percentage solids is not critical for the agglomeration step, can, for example, be a pipeline slurry. The aqueous suspension may have been obtained by grinding coal lumps wet, i.e. in the presence of water and—if desired—by mixing the obtained mass of ground coal with an extra amount of water. Wet grinding of coal lumps has some advantages over dry grinding; less energy is required, dust problems are eliminated and there is no explosion danger.

The aqueous suspension is more particularly defined as an aqueous ash-containing suspension of coal particles. The term denotes an aqueous suspension of particles that consists mainly of coal, but also contains coal particles which contain ash and/or ash particles besides the coal particles.

As mentioned, the suspension is to be treated under turbulent conditions in an agglomeration device with a suitable binder. By contacting the suspension at normal or elevated temperature with a suitable binder and by stirring vigorously, agglomerates of coal particles and binder are formed. The binder should be of the type that is capable of causing coal particles to stick together, to the extent that the particles are wetted by the binder, are rendered hydrophobic and stick together. The ash particles that are set free during the stirring, however, do not have such affinity for the binder and are to a great extent not taken up in the agglomerates. Due to the hydrophobic character of the agglomerates, it is relatively simple to separate them from the water phase, which separation could, for example, be effected by passing the stream of agglomerate-containing water, which originates from the agglomeration device, over a sieve on which the agglomerates remain. Also, it is possible, for example, to add in a separate mixing device an amount of hydrocarbons to the agglomerate-containing water phase, so that two phases are present in this mixing device and the agglomerates migrate from the water phase into the hydrocarbon phase. The agglomerates can then be transported while suspended in hydrocarbon. In all these cases, the ash-containing water phase may be separately withdrawn and processed.

The agglomerates are to be taken up in a hydrocarbon fuel. This can be done during and/or after the separation of agglomerates and water phase. The agglomerates can, after the said separation, for example, be mixed at once with the total amount of hydrocarbon fuel. The agglomerates disintegrate and the mixture obtained is a homogeneous suspension of coal particles in hydrocarbon fuel. It is also possible to mix the agglomerates with a portion of the total required amount of hydrocarbon fuel, as a result of which a thick sludge is obtained which can subsequently be diluted with the remainder of the hydrocarbon fuel. The obtained suspension, if desired, can then be specially homogenized.

After separation of the agglomerates from the water phase, the agglomerates can suitably be distintegrated in the absence of the hydrocarbon fuel. This can, for example, be done in a mill. It is preferred, however, to disintegrate them while they are already mixed with at least part of the total required amount of hydrocarbon fuel.

For the proposed process, all sorts of coal are, in principle, suitable, including the solid fuels that are related to coal, such as lignite, peat, bituminous coal, soot, coke, etc.

The hydrocarbon fuel may be one of the usual liquid fuels that are obtained from the processing of crude oil. The fuels based on heavy oil fractions, such as fuel oil, lend themselves especially well for application in the present process.

As a binder for the agglomeration of the coal particles a permanent binder may be chosen, i.e. a binder which is ultimately taken up in the fuel. It is also possible, however, to choose a type of binder that is regained from the agglomerates in the course of the process of the proposal and which is then recirculated. This is possible, for example, by using a light hydrocarbon fraction as a binder and a heavy fraction as the fuel. The agglomerates may then be mixed with the fuel at a temperature above the boiling point or range of the binder, whereby the binder can be regained.

Suitable binders are, in principle, all liquids, or substances that are liquid at agglomerative conditions, which are wholly or partly based on hydrocarbons, provided they have the other suitable properties. This holds for all kinds of products obtained from oil or coal, such as naphtha, gas oil, fuel oil, bitumen, coal tar, etc.

It is by all means possible, in principle, to use the applied fuel also as a binder.

Depending on the concentration of solids in the aqueous suspension, on the type of binder used and the applied amount and on the flow conditions, during stirring, various types of agglomerates may be obtained, ranging from loosely bound, fluffy material to hard pellets.

It has been experienced that complete deashing or deashing to the required degree may not always be reached at once, especially in cases where a high percentage of ash is originally present in the coal. In this case, it is preferred according to the proposal to mix the obtained agglomerates after separation from the ash-containing water phase with an additional amount of water and to disintegrate the agglomerates, to add additional binder and to re-agglomerate the coal under turbulent conditions, whereafter the fresh agglomerates are separated from the ash-containing water and taken up in the hydrocarbon fuel. Thus an additional deashing is obtained. The agglomerates can be disintegrated before, during and/or after addition of extra water in the first stage and addition of hydrocarbon fuel in the second stage.

It has also been proposed to perform the first agglomeration step of the above-mentioned two stage agglomeration process in a high shear agglomeration device in which, apart from the agglomeration itself, the coal particles are further ground, whereby even more ash particles are liberated and thus separated.

It has now been discovered that to obtain a statically and dynamically stable suspension of coal particles in a hydrocarbon fuel in the above-described process with a solids load that is as high as possible, it is crucial that the suspension contains no coarse particles.

However, if this requirement is met by grinding the coal particles of the aqueous suspension of ash-containing coal particles in one grinding step, a large amount of very fine particles will be formed. This is a disadvantage because it increases the viscosity of the produced suspension of coal particles in hydrocarbon fuel and thus limits the amount of coal which can be dispersed in the hydrocarbon fuel.

The present invention aims at overcoming this drawback.

SUMMARY OF THE INVENTION

Accordingly, the invention provides a process for preparing a suspension of coal particles in a hydrocarbon fuel comprising contacting an aqueous suspension of ash-containing coal particles under turbulent conditions in an agglomeration zone with a binder, preferably hydrocarbon based, to form agglomerates of coal particles and binder, while excluding at least part of the ash, separating the agglomerates from an ash-containing water phase by taking the agglomerates up in a hydrocarbon fuel and by disintegrating the agglomerates, while in said hydrocarbon fuel to suspend the resulting coal particles in the hydrocarbon fuel, in which process from the suspension of coal particles in hydrocarbon fuel so obtained at least part of the largest coal particles are separated, ground and recirculated to the agglomeration zone.

In this way, coal particles of an undesired size need not be present in the produced suspension and yet the initial grinding of the coal need not be carried out beyond an economically acceptable degree.

In the above-mentioned two-stage deashing process, the separation of the coarse particles can, of course, be carried out on the product.

However, according to a preferred embodiment, the invention comprises a process for preparing a suspension of coal particles in a hydrocarbon fuel comprising contacting an aqueous suspension of ash-containing coal particles under turbulent conditions in a first agglomeration zone with a binder to form agglomerates of coal particles and binder, while excluding at least part of the ash, separating the agglomerates from an ash-containing water phase, mixing the agglomerates with an additional amount of water and disintegrating the agglomerates, adding additional binder and re-agglomerating the coal under turbulent conditions in a second agglomeration zone, separating the agglomerates obtained in the second agglomeration zone from ash-containing water by taking up the agglomerates in a hydrocarbon fuel and disintegrating the agglomerates, while in said hydrocarbon fuel, to suspend the resulting coal particles in the hydrocarbon fuel, in which process from the slurry obtained by disintegrating the agglomerates from the first agglomeration zone and taking them up in the additional amount of water at least part of the largest coal particles are separated, ground and recirculated to the first agglomeration zone. Thus, the coarse particles need not go through the second agglomeration zone. The process of present invention compares favorably with one in which the coarse particles are separated from the (aqueous) suspension before passing the latter to the agglomeration device, since in that case coarse ash particles are also removed and recycled.

According to a preferred embodiment of the invention, particles larger than 80 μm are separated from the suspension of coal particles in hydrocarbon fuel. The separation of the largest particles is preferably carried out with a centrifuge.

If the aqueous suspension of coal particles has been obtained by grinding coal lumps wet in a mill, the said largest particles can very suitably be recycled to the agglomeration device via the mill.

We claim as our invention:

1. In a process for preparing a suspension of coal particles in a hydrocarbon fuel in which an aqueous suspension of ash-containing coal particles and a binder are agglomerated in an agglomeration zone to produce agglomerates of coal particles and binder, and an ash-containing water phase, the agglomerates are separated from the ash-containing water phase and suspended in a hydrocarbon fuel, the agglomerates being disintegrated and the resulting coal particles becoming suspended in the hydrocarbon fuel, the improvement comprising, separating at least a portion of the coarse particles suspended in the hydrocarbon fuel, grinding the coarse particles, and returning the ground particles to the agglomeration zone.

2. The process of claim 1, in which the agglomerates are separated from the ash-containing water phase by passing the agglomerates and the ash-containing water phase over a sieve on which the agglomerates remain.

3. The process of claim 1 in which the agglomerates are separated from the ash-containing water phase by adding, in a separate mixing zone, an amount of hydrocarbons to the agglomerate-containing water phase, so that two phases, a hydrocarbon phase and a water phase, are present in the mixing zone, and the agglomerates migrate from the water phase into the hydrocarbon phase.

4. The process as of claim 1 in which, after the separation of the agglomerates from the water phase, the agglomerates are mixed with the total amount of hydrocarbon fuel.

5. The process of claim 1 in which, after the separation of the agglomerates from the water phase, the agglomerates are mixed with a portion of the total required amount of hydrocarbon fuel to obtain a thick sludge, and the thick sludge is diluted with the remainder of the hydrocarbon fuel.

6. The process of claim 1 in which the hydrocarbon fuel is a fuel based on heavy oil fractions.

7. The process of claim 1 in which the binder is taken up in the fuel.

8. The process of claim 1 in which the binder is recovered from the agglomerates and recycled.

9. The process of claim 8 in which the binder is a light hydrocarbon fraction and the fuel is a heavy fraction, and the agglomerates are mixed with the fuel at a temperature above the boiling point or range of the binder.

10. The process of claim 1 in which the hydrocarbon fuel is also used as a binder.

11. The process of claim 1 in which the agglomerates obtained after separation from the ash-containing water phase are mixed with an additional amount of water and additional binder, the agglomerates are disintegrated, the coal is re-agglomerated, and the fresh agglomerates are separated from ash-containing water and taken up in a hydrocarbon fuel.

12. In a process for preparing a suspension of coal particles in a hydrocarbon fuel in which an aqueous suspension of ash-containing coal particles and a hydrocarbon-based binder are agglomerated in an agglomeration zone to produce agglomerates of coal particles and binder, and an ash-containing water phase, the agglomerates are separated from the ash-containing water phase and suspended in a hydrocarbon fuel, the agglomerates being disintegrated and the resulting coal particles becoming suspended in the hydrocarbon fuel, the improvement comprising, separating at least a portion of the coarse particles suspended in the hydrocarbon fuel, grinding the coarse particles, and returning the ground particles to the agglomeration zone.

13. The process of claim 12 in which the agglomerates are separated from the ash-containing water phase by adding, in a separate mixing zone, an amount of hydrocarbons to the agglomerate-containing water phase, so that two phases, a hydrocarbon phase and a water phase, are present in the mixing zone, and the agglomerates migrate from the water phase into the hydrocarbon phase.

14. The process as of claim 12 in which, after the separation of the agglomerates from the water phase, the agglomerates are mixed with the total amount of hydrocarbon fuel.

15. The process of claim 13 in which, after the separation of the agglomerates from the water phase, the agglomerates are mixed with a portion of the total required amount of hydrocarbon fuel to obtain a thick sludge, and the thick sludge is diluted with the remainder of the hydrocarbon fuel.

* * * * *